US012742299B2

(12) United States Patent
Gerritsen et al.

(10) Patent No.: US 12,742,299 B2
(45) Date of Patent: Sep. 22, 2026

(54) EROSION CONTROL SYSTEM, AND A PROCESS FOR MANUFACTURING THE EROSION CONTROL SYSTEM

(71) Applicant: FREUDENBERG PERFORMANCE MATERIALS B.V., Arnhem (NL)

(72) Inventors: Rijk Gerritsen, Loenen (NL); Kennard Van Malenstein, Putten (NL); Erik-Jan Kollen, Oosterbeek (NL); Lucas Brouwers, Arnhem (NL)

(73) Assignee: FREUDENBERG PERFORMANCE MATERIALS B.V., Arnhem (NL)

( * ) Notice: Subject to any disclaimer, the term of this patent is extended or adjusted under 35 U.S.C. 154(b) by 357 days.

(21) Appl. No.: 18/032,641

(22) PCT Filed: Oct. 27, 2021

(86) PCT No.: PCT/EP2021/079797

§ 371 (c)(1),
(2) Date: Apr. 19, 2023

(87) PCT Pub. No.: WO2022/090301

PCT Pub. Date: May 5, 2022

(65) Prior Publication Data

US 2023/0407588 A1 Dec. 21, 2023

(30) Foreign Application Priority Data

Oct. 28, 2020 (EP) ..... 20204373

(51) Int. Cl.
*E02B 3/12* (2006.01)
*E02D 17/20* (2006.01)

(52) U.S. Cl.
CPC ..... *E02B 3/122* (2013.01); *E02D 17/202* (2013.01); *E02D 2250/00* (2013.01); *E02D 2300/0025* (2013.01); *E02D 2300/0051* (2013.01); *E02D 2300/0076* (2013.01); *E02D 2300/0078* (2013.01); *E02D 2300/0079* (2013.01)

(58) Field of Classification Search
CPC ..... E02D 17/20; E02D 17/202; E02B 13/122; E02B 13/125; E02B 13/126
USPC ..... 405/19, 30, 32, 33, 302.6, 302.7
See application file for complete search history.

(56) References Cited

U.S. PATENT DOCUMENTS

| | | | | | |
|---|---|---|---|---|---|
| 3,705,467 | A * | 12/1972 | McKnight | A01C 1/06 | 106/900 |
| 5,342,150 | A * | 8/1994 | Kitchen | E21D 15/005 | 405/303 |
| 6,484,473 | B1 * | 11/2002 | Hall | E02D 17/202 | 428/137 |
| 10,011,965 | B2 * | 7/2018 | Lipscomb | E02B 3/122 | |

FOREIGN PATENT DOCUMENTS

| | | | |
|---|---|---|---|
| EP | 0 071 213 | A2 | 2/1983 |
| GB | 2 440 147 | A | 1/2008 |
| KR | 10-0874276 | B1 | 12/2008 |
| KR | 1073969 | * | 10/2011 |
| WO | 2005/116345 | A1 | 12/2005 |
| WO | 2009/112840 | A1 | 9/2009 |
| WO | WO 2014/114626 | * | 7/2014 |

OTHER PUBLICATIONS https://pubs.usgs.gov/sir/2008/5093/table3.html; 2013.*
https://www.engineeringtoolbox.com/dirt-mud-densities-d_1727.html; 2010.*
Feb. 4, 2022 International Search Report issued in International Patent Application No. PCT/EP2021/079797.

* cited by examiner

*Primary Examiner* — Sean D Andrish
(74) *Attorney, Agent, or Firm* — Oliff PLC

(57) ABSTRACT

An erosion control system is disclosed for preventing erosion of embankments including a three-dimensional material, the three-dimensional material including void volumes, and a mixture including a particulate material and a binder material included in the void volumes, wherein the binder material includes an organic binder material derived from living matter.

14 Claims, No Drawings

EROSION CONTROL SYSTEM, AND A PROCESS FOR MANUFACTURING THE EROSION CONTROL SYSTEM

CROSS REFERENCE TO RELATED APPLICATIONS

This application is a national stage entry of PCT/EP2021/079797 filed on Oct. 27, 2021 which in turn claims priority to EP 20204373.3 filed on Oct. 28, 2020, of which are incorporated by reference.

BACKGROUND

The invention pertains to an erosion control system for use in segments of civil engineering, hydraulic engineering, building and construction, and a process for manufacturing the erosion control system.

Earth embankments or slopes of for example canals and rivers, which are exposed to hydraulic stress from high water velocities and/or small wave attack are susceptible to erosion.

Erosion is the action of surface processes, such as water flow or wind acting on the surface, that removes soil, rock or dissolved material and transports these materials to another location causing sedimentation. Erosion can have huge impact on the environment, like loss of fertile soil, gully erosion, slope instability, collapse of flood defences and undermining constructions. It is therefore desired to reduce the risk, or at least reduce the impact of erosion by using erosion control systems.

Constituents of a natural source, such as woven fabrics of jute or cocos fibers, are sometimes used as an erosion control system. However, such materials only provide a short-term solution as these materials decompose in situ within approximately six months up to a maximum performance as an erosion control system of two to three years.

An alternative constituent for erosion control systems is the use of plastic matting, made from polymers such as polypropylene (PP), polyethylene (PE) or polyamide (PA). Erosion control systems made of these plastic matting constituents have been introduced in the market since the 1980's and have been widely used as erosion control systems. The application of these erosion control systems comprising plastic matting constituents is mainly for dry slopes.

More heavy duty solutions have been assessed including a three-dimensional mat of entangled filaments pre-filled with bitumen-bound stone chippings, which provides a durable solution to erosion caused by hydraulic stress when laid on soil slopes exposed to water.

Although the proposed solutions, and in particular the three-dimensional mat of entangled filaments filled with bitumen-bound stone chippings, provide a very durable solution to prevent erosion of embankments by hydraulic stress, there are increasing concerns due to the bitumen binder material being in direct contact with the environment, in particular with soil particles and/or water flow.

Furthermore, there is a strong desire to reduce the carbon footprint of building materials and to reach ultimately in 2030 $CO_2$ neutrality to civil and building constructions and ultimately circular use of building materials in 2050.

An object is to provide a more sustainable material solution for erosion control systems of embankments and slopes.

DETAILED DESCRIPTION

The erosion control system for erosion control of embankments comprising a three-dimensional material, the three-dimensional material comprising void volumes, and a mixture comprising a particulate material and a binder material comprised in the void volumes, the binder material being capable of forming hydrogen bonds enables to provide a more sustainable erosion control system, for preventing, or at least reducing, erosion of embankments or slopes, which are susceptible to erosion for example due exposure to hydraulic stress, for such as from high water velocities and/or small wave attack.

The erosion control system can be used, to prevent or at least reduce, erosion of embankments, such as for example wet or dry earth slopes, or other surfaces where protection against erosion is needed, such as for example dug slopes or natural slopes e.g. of waterways, such as rivers, lakes or canals.

The three-dimensional material comprising void volumes preferably is a three-dimensional textile material. Preferably, the three-dimensional textile material is a three-dimensional geotextile material.

The term three-dimensional material is understood to mean a material having a thickness of at least 10 mm, preferably a thickness of at least 15 mm, more preferably a thickness of at least 20 mm.

A two-dimensional material or a two-dimensional material layer is understood to have a thickness of at most 5 mm, preferably at most 3 mm, more preferably at most 2 mm.

The three-dimensional material comprised in the erosion control system provides mechanical interlocking of the particulate material and provides a matrix that retains the particulate material in the manufacturing of the erosion control system.

The particulate material comprised in the void volumes of the three-dimensional material may be any suitable particulate material which can withstand forces, such as for example hydraulic stress, over a prolonged period of time, preferably at least 3 years, more preferably at least 10 years, more preferably at least 20 years, most preferably at least 30 years. The particulate material comprised in the void volumes of the three-dimensional material may be any organic or inorganic particulate material that itself has a density greater than the density of water, or that in combination with the binder material has a density has a density greater than the density of water.

The particulate material comprised in the void volumes of the three-dimensional material may include sand, gravel, seashells, the seashells either crushed or not, organic materials (potentially coming from other processes or waste streams) such as starch, polyhydroxybutyrate (PHB), cellulose and cellulose derivatives, such as wood or cellulose acetate, poly(butylene succinate-co-butylene adipate) (PBSA), poly(butylene adipate-co-terephthalate) (PBAT), polylactic acid polymer (PLA), polybutylene succinate (PBS) provided that the density of the complete erosion control system is gravity high enough to prevent floating of the erosion control system. Preferably, the particulate material comprised in the void volumes of the three-dimensional material does not react with the environment under the environmental conditions.

The particulate material comprised in the void volumes of the three-dimensional material may comprise natural minerals, such as stone chippings originating for example from gravels or rock materials, olivine, debris granulate, recycled building or consumer materials, glass, processed and dewatered sludge, such as for example sediments, sewage systems, industrial or mining sediments.

Preferably, the particulate material comprised in the void volumes of the three-dimensional material comprises stone chippings. Stone chippings are a natural material and generally do not pose a risk of contamination of the soil and water flow.

The particulate material comprised in the void volumes of the three-dimensional material may have dimensions and/or shapes which enable that the erosion control system for preventing erosion of embankments is sufficiently porous, allowing root systems of vegetation to grow through the erosion control system for preventing erosion of embankments and/or allowing green shoots to sprout through the erosion control system, which creates an anchoring of the erosion control system to the surface, such as for example a soil, underneath the erosion control system.

The erosion control system may have a porosity in the range of 15% to 70%, preferably in the range of 25% to 65%, more preferably in the range of 35% to 55%, most preferably in the range of 40% to 50%, wherein the porosity of the erosion control system is determined as follows. A container is completely filled with water and weighed. A sample of 10 cm×10 cm of the erosion control system is enclosed in a sealed and vacuumed bag, and placed in the container.

Introduction of the vacuumed bag in the container displaces an amount of water equal to the total volume of the sample of the erosion control system. After removal of the vacuumed bag from the container, the container is weighed again, and the reduction in weight determines the amount of water (V0), which is displaced by the total volume of the sample of the erosion control system. The container is then refilled completely with water and weighed. The sample of the erosion control system is taken out of the vacuumed bag, and placed in the container. After 15 minutes the sample of the erosion control system is removed from the container. After removal of the sample of the erosion control system from the container, the container is weighed again and the reduction in weight determines the amount of water (V1), which is displaced by the volume of the sample of the erosion control system which is not accessible to water. The amount of water (V2) which has entered into the sample of the erosion control system equals to V2=V0−V1, and determines the open volume of the erosion control system. The porosity of the erosion control system is calculated as a percentage of the open volume of the erosion control system divided by the total volume of the sample of the erosion control system, i.e. porosity=V2/V0.

Vegetation development on the erosion control system further enables to provide a natural appearance to the surface onto the which the erosion control system is applied, contributing to greening of the environment (visual attraction), climate temperature cooling effects, sustainable building principles and $CO_2$ capture by vegetation growth.

The erosion control system is sufficiently porous to ensure that there is no hydrostatic pressure build-up behind the protected embankments. If needed additional measures may be taken to avoid, or at least reduce, hydrostatic forces, by combining the erosion control system with pressures absorbing means and/or with means for drainage of excess water.

The particulate material comprised in the void volumes of the three-dimensional material may have any shape which provides stability to the erosion control system. The particulate material comprised in the void volumes of the three-dimensional material may have a particle size in the range of 0.5 mm to 15 mm, preferably in the range of 1 mm to 10 mm, more preferably in the range of 1.5 mm to 8 mm, most preferably in the range of 2 mm to 6 mm, wherein the particle size being determined as the maximum distance defined by a straight line between two opposing sides of the particulate material, the straight line crossing through the centre of gravity of the particulate material.

The three-dimensional material may be any suitable three-dimensional material which comprises void volumes wherein the mixture comprising the particulate material and the binder material can be introduced and retained. Preferably, the three-dimensional material comprising void volumes is a three-dimensional textile material.

The three-dimensional material may comprise an open cell foam comprising void volumes which are large enough to allow the mixture comprising the particulate material and the binder material to be introduced into the void volumes.

The three-dimensional textile material may comprise a three-dimensional woven fabric or a three-dimensional knitted fabric. Examples of three-dimensional woven or knitted fabrics are spacer fabrics. Such woven or knitted spacer fabrics can be used as the three-dimensional textile material in the erosion control system provided that openings in a surface of the three-dimensional woven or knitted fabrics are sufficiently large to allow the mixture comprising the particulate material and the binder material to be introduced into void volumes of the three-dimensional woven or knitted fabric.

The three-dimensional material may comprise a two-dimensional material and loops extending in a perpendicular direction from a surface of the two-dimensional material, wherein the three-dimensional material comprises void volumes between the loops extending in a perpendicular direction from a surface of the two-dimensional material. Preferably, the loops are formed of monofilament or multifilament yarns tufted into the two-dimensional material, thereby providing a secure and durable connection between the loops and the two-dimensional material. The mixture comprising the particulate material and the binder material can be introduced into the void volumes between the loops.

The two-dimensional material may be a closed film, a perforated film, a non-woven fabric, a knitted fabric or a woven fabric, provided that any apertures in the two-dimensional material are sufficiently small to retain the mixture comprising the particulate material and the binder material in the void volumes. Preferably, the aperture size (O90) in the two-dimensional material is at most 1.0 mm, more preferably at most 0.75 mm, more preferably at most 0.5 mm, most preferably at most 0.25 mm, as determined according to EN ISO 12956 (wet).

The loops may also advantageously be formed by forming loops directly in the weaving process when manufacturing the two-dimensional material as a woven fabric.

The three-dimensional textile material may comprise a three-dimensional structure of, preferably entangled, filaments. The filaments of the three-dimensional structure of filaments may have an equivalent diameter in the range from 0.1 mm to 2.5 mm, preferably in the range from 0.2 mm to 2.0 mm, more preferably in the range from 0.3 mm to 1.5 mm, more preferably in the range or 0.4 mm to 1.2 mm, and most preferably in the range from 0.5 to 0.8 mm.

The three-dimensional structure of, preferably entangled, filaments comprised in the three-dimensional textile material preferably comprises at least 75 vol. % of void volumes (i.e. at maximum 25 vol. % of the three-dimensional structure is occupied by the entangled filaments), preferably at least 90 vol. % of void volumes, more preferably at least 95 vol. % of void volumes, which allows a high loading of the mixture comprising the particulate material and the binder material in the three-dimensional structure of filaments.

The, preferably entangled, filaments in the three-dimensional structure of filaments contact each other at crossing points between the filaments and the filaments may be thermally bonded to each other at the crossing points.

Alternatively, the preferably entangled, filaments in the three-dimensional structure of entangled filaments may be bonded to each other at the crossing points by glue bonding, ultrasonic bonding or chemical bonding.

The filaments in the three-dimensional structure of, preferably entangled, filaments may be mono-component filaments comprising only one polymer or only one blend of polymers.

The filaments in the three-dimensional structure of, preferably entangled, filaments may be bi-component filaments comprising a first component comprising a first polymer or a first blend of polymers and a second component comprising a second polymer or a second blend of polymers. The bicomponent filaments in the three-dimensional structure of filaments may have any cross-sectional configuration, including a side-by-side configuration, a segmented-pie configuration, an islands-in-the-sea configuration, or a core/sheath configuration. Preferably, the bicomponent filaments have a core/sheath configuration for improved thermal bonding of the filaments to each other at the crossing points.

The three-dimensional structure of, preferably entangled, filaments comprised in the three-dimensional textile material may be connected to a two-dimensional material layer, which enables that the mixture comprising the particulate material and the binder material is retained within the three-dimensional structure of filaments when the mixture is introduced into the void volumes. The two-dimensional material layer connected to the three-dimensional structure of entangled filaments may be a geogrid, a closed film, a perforated film, a non-woven fabric, a knitted fabric or a woven fabric, provided that any apertures in the two-dimensional material layer are sufficiently small to retain the mixture comprising the particulate material and the binder material within the three-dimensional structure of, preferably entangled, filaments. Preferably, the aperture size (090) in the two-dimensional material layer is at most 1.0 mm, more preferably at most 0.75 mm, more preferably at most 0.5 mm, most preferably at most 0.25 mm.

The three-dimensional textile material may comprise a geogrid, preferably connected to, or embedded in, the three-dimensional structure of, preferably entangled, filaments to provide reinforcement to the three-dimensional textile material allowing application of the erosion control system in challenging environments, such as for example on steep slopes. A geogrid is understood to mean a material consisting of connected parallel sets of high strength, tensile ribs with apertures of sufficient size to allow strike-through of surrounding soil, stone, or other geotechnical material.

The non-woven fabric forming the two-dimensional material layer connected to the three-dimensional structure of filaments may be any type of nonwoven, such as for example a staple fiber nonwoven produced by well-known processes, such as carding processes, wet-laid processes or air-laid processes or any combination thereof. The nonwoven fabric may also be a nonwoven composed of filaments produced by well-known spunbonding processes wherein filaments are extruded from a spinneret and subsequently laid down on a conveyor belt as a web of filaments and subsequently bonding the web to form a nonwoven layer of fibers, or by a two-step process wherein filaments are spun and wound on bobbins, preferably in the form of multifilament yarns, followed by the step of unwinding the multifilament yarns and laying the filaments down on a conveyor belt as a web of filaments and bonding the web to form a nonwoven carrier material of fibers.

Preferably, the non-woven fabric forming the two-dimensional material layer connected to the three-dimensional structure of filaments comprises filaments in order to provide higher tensile strength and/or higher tear strength to the three-dimensional textile material and/or to the erosion control system for preventing erosion of embankments or slopes.

The two-dimensional material layer connected to the three-dimensional structure of filaments may also be a two-dimensional layer of, preferably entangled, filaments. The filaments of the two-dimensional material layer of, preferably entangled, filaments may have an equivalent diameter in the range from 0.1 mm to 2.5 mm, preferably in the range from 0.2 mm to 2.0 mm, more preferably in the range from 0.3 mm to 1.5 mm, more preferably in the range or 0.4 mm to 1.2 mm, and most preferably in the range from 0.5 to 0.8 mm.

The filaments of the two-dimensional layer of, preferably entangled, filaments may have the same equivalent diameter, and preferably the same cross-sectional shape and/or the same composition, as the filaments of the three-dimensional structure of filaments.

The two-dimensional layer of, preferably entangled, filaments may be formed simultaneously with the three-dimensional structure of entangled filaments in an integrated process. Alternatively, the two-dimensional layer of filaments may be formed separately from the three-dimensional structure of filaments, and subsequently be connected to the three-dimensional structure of, preferably entangled, filaments.

The three-dimensional structure of filaments may be provided by extruding polymeric filaments and collecting the extruded filaments into a three-dimensional structure by allowing the filaments to bend, preferably to entangle, and to come into contact with each other, preferably in a still molten state. Bending and entangling of the extruded filaments are preferably initiated by collecting the extruded filaments onto a profiled surface, which defines the structure of the three-dimensional structure of entangled filaments. Preferably, the surface on which the extruded filaments are collected is profiled such that the three-dimensional structure of filaments is shaped into a three-dimensional form which comprises hills and valleys, hemispheres, positive and/or negative cuspates, cups and/or waffles, pyramids, truncated pyramids, U-grooves, V-grooves, cones, truncated cones and/or cylinders capped with a hemisphere.

The two-dimensional structure of, preferably entangled, filaments may be provided by extruding polymeric filaments and collecting the extruded filaments into a two-dimensional structure by allowing the filaments to bend and to come into contact with each other, preferably in a still molten state. Bending of the extruded filaments are preferably initiated by collecting the extruded filaments onto a non-profiled surface.

The three-dimensional structure of filaments may have a thickness in the range of 10 mm to 25 mm. Preferably, the three-dimensional structure of filaments has a thickness of at least 10 mm, preferably a thickness of at least 15 mm, more preferably a thickness of at least 20 mm, wherein the thickness is determined according to EN ISO 9863-2, at a pressure of 2 kPa. However, the three-dimensional structure of filaments may have a thickness of more than of 25 mm for heavy duty applications.

The erosion control system may have a weight in the range of 5 kg/m$^2$ to 50 kg/m$^2$, preferably in the range of 10 kg/m$^2$ to 30 kg/m$^2$, more preferably in the range of 15 kg/m$^2$ to 25 kg/m$^2$.

The three-dimensional material may be composed of any material, in particular of any polymer or combination of two or more polymers, which is capable of resisting the temperature at which the mixture comprising a particulate material and a binder material is introduced into the void volumes of the three-dimensional material. The temperature at which the mixture comprising a particulate material and a binder material is introduced into the void volumes of the three-dimensional material may be in the range of 170° C. to 200° C., in particular when the mixture to be introduced into the void volumes comprises a bitumen-based binder material.

The three-dimensional material may be composed of a polymer or a combination of two or more polymers including polyesters, such as for example polyethylene terephthalate (PET) (based either on DMT or PTA), polybutylene terephthalate (PBT), polytrimethylene terephthalate (PTT), polyethylene naphthalate (PEN) and/or polylactic acid (PLA), polyamides, such as for example polyamide-6 (PA6), polyamide-6,6 (PA6,6) and/or polyamide-6,10 (PA6,10), polyphenylenesulfide (PPS), polyethyleneimide (PEI) and/or polyoxymethylene (POM) and/or any copolymer or any blend of at least two of said polymers.

The three-dimensional material may be composed of a polyester, in particular a polyethylene terephthalate, which is able to resist the temperature at which the mixture comprising the particulate material and the binder material is introduced into the void volumes of the three-dimensional material.

The three-dimensional material may be composed of a polyamide, in particular a polyamide-6, which is able to resist the temperature at which the mixture comprising the particulate material and the binder material is introduced into the void volumes of the three-dimensional material, and which provides flexibility and resilience to the three-dimensional material and the erosion control system, improving the ease of application when applying the erosion control system onto the surface to be protected against erosion, allowing the erosion control system to be rolled up, preferably onto a core, and enabling access onto the three-dimensional material and onto the erosion control system, even with heavy machinery, such as a roller, without significantly reducing the thickness of the three-dimensional material or of the erosion control system.

The three-dimensional material may advantageously be composed of one or more polymer and/or one or more blends of polymers from renewable resources. Preferably, the three-dimensional material is composed of a polylactic acid polymer (PLA), polybutylene succinate (PBS), poly (butylene adipate-co-terephthalate) (PBAT), poly(butylene succinate-co-butylene adipate) (PBSA), cellulose acetate, cellulose, polyhydroxybutyrate (PHB), or any blend thereof comprising one or more of these polymers.

The binder material comprised in the void volumes of the three-dimensional material comprises a binder material which is capable of forming hydrogen bonds. The binder material may include bitumen, cement, polyurethane, lignin, rubber, cellulose, latex, volcanic tuff, lime, algae or sewage sludge extractions.

The binder material may be sourced from fossil-fuel, but preferably the binder material comprises a major component of bio-based material and preferably from sustainable sources.

The binder material in the erosion control system may comprise an organic binder material, preferably at least 20 wt. % of an organic binder material, based on the total amount of binder material The binder material comprised in the void volumes may comprise an organic binder material. The binder material may comprise at least 20 wt. % of an organic binder material, based on the total amount of binder material, preferably at least 30 wt. %, more preferably at least 40 wt. %, more preferably at least 50 wt. % more preferably at least 75 wt. %, more preferably at least 90 wt. % of an organic binder material, based on the total amount of binder material. The term organic binder material is understood to mean that constituents of the binder material are derived from living matter, not from fossil sources. The organic binder material may be derived from organic waste, residues and plant material, such as waste from agriculture and municipals, agricultural crop and by product from forestry. Preferably, the organic binder material is derived from plant material.

The organic binder material may be selected from latex binders, hot melt adhesives, in particular an acrylic hot melt adhesive, two-component binder systems, in particular a two-component polyurethane binder system, emulsion binders, bitumen-based binders comprising organic additives derived from living matter and resins harvested from trees.

The organic binder material enables to provide forces strong enough to hold all components of the erosion control system together, while having reduced environmental impact, wherein the forces may be chemical adhesion forces, dispersive adhesion forces or diffusive adhesion forces.

The organic binder material may be cross-linked to improve bonding of the components of the erosion control system to each other.

The binder material comprised in the void volumes may comprise a lignin-based binder material. The binder material may comprise at least 20 wt. % of a lignin-based binder material, based on the total amount of binder material, preferably at least 30 wt. %, more preferably at least 40 wt. %, more preferably at least 50 wt. % more preferably at least 75 wt. %, more preferably at least 90 wt. % of a lignin-based binder material, based on the total amount of binder material.

The binder material comprised in the void volumes may comprise one or more further binder materials, which preferably are provided from renewable resources, including natural rubber, polylactic acid polymer (PLA) polybutylene succinate (PBS), poly(butylene adipate-co-terephthalate) (PBAT), poly(butylene succinate-co-butylene adipate) (PBSA), cellulose acetate, cellulose, and/or polyhydroxybutyrate (PHB).

The binder material comprised in the void volumes preferably consists of a lignin-based binder material.

The binder material comprised in the void volumes may further comprise a bitumen-based binder material. The binder material may comprise at most 80 wt. % of a bitumen-based binder material, based on the total amount of binder material, preferably at most 70 wt. %, more preferably at most 60 wt. %, more preferably at most 50 wt. % more preferably at most 25 wt. %, more preferably at most 10 wt. % of a lignin-based binder material, based on the total amount of binder material.

Reducing the amount of bitumen-based binder material reduces the carbon footprint of the erosion control system.

The binder material comprised in the void volumes preferably does not comprise a bitumen-based binder material.

The binder material comprised in the void volumes of the three-dimensional material may comprise a two-component polyurethane binder and/or a latex binder, which may have been cross-linked.

The temperature at which the mixture comprising the particulate material and the binder material is introduced into the void volumes of the three-dimensional material can be reduced to a temperature in the range of 120° C. to 150° C. when the binder material comprises a lignin-based binder material, in an amount of at least 20 wt. % and up to 100 wt. %, based on the total amount of binder material.

The three-dimensional material may be composed of a polyolefin, in particular a polypropylene, providing improved durability of the erosion control system for preventing erosion of embankments, especially in a brackish marine environment, in particular when the binder material comprises a lignin-based binder material, in an amount of at least 20 wt. % and up to 100 wt. %, based on the total amount of binder material.

It has been observed that, when the binder material comprised in the void volumes comprises a lignin-based binder in an amount of at least 20 wt. % and at most 80 wt. % of a bitumen-based binder, based on the total amount of binder material, the erosion control system exhibits improved flexibility as compared to an erosion control system comprising only a bitumen-based binder. The erosion control system comprising a lignin-based binder in an amount of at least 20 wt. % and at most 80 wt. % of a bitumen-based binder, can be rolled up easily after introducing the mixture comprising the particulate material and the binder material into the void volumes, and can be unrolled again to lie flat on the surface to be protected, avoiding, or at least reducing, crack formation in the erosion control system when unrolling the erosion control system, as compared to an erosion control system wherein the binder material comprises only bitumen-based binder.

It has been observed that the binder material comprising a lignin-based binder in an amount of at least 20 wt. % and at most 80 wt. % of a bitumen-based binder, based on the total amount of binder material, provides improved bonding of the particulate material within the three-dimensional material of the erosion control system as compared to an erosion control system comprising only bitumen-based binder.

A fine granular material may be provided onto at least one of the surfaces of the erosion control system, preferably onto both of the surfaces, to prevent that consecutive layers of the erosion control system on a roll adhere strongly to each other, which would complicate unrolling of the erosion control system onto the surface to be protected. The fine granular material may include sand and/or top soil (black soil) and/or wood chips and may include additives, such as fertilizers. In addition, the fine granular material, in particular in the case of sand, can stimulate vegetation growth and provide an improved natural appearance of the surface (visual attractiveness), until vegetation grows on and/or through the erosion control system.

The lignin-based binder material can advantageously be sourced from renewable sources, for example from plant material, thereby reducing the carbon footprint of the erosion control system as compared to an erosion control system wherein the binder material comprises only bitumen-based binder from a fossil source.

The lignin-based binder material may be isolated from plants which can grow on very arid and nutrient-poor soils, such as for example from the plant *Mischanthus*, thereby not only reducing the carbon footprint, but also providing a more sustainable lignin-based binder material for the erosion control system, as growing of these species of plants does not compete with growing crops on high quality agricultural land for producing food for humans and/or for livestock farming.

The mixture comprising the particulate material and the binder material introduced into and comprised in the void volumes of the three-dimensional material may further comprise reinforcing fibers to further stabilize the erosion control system, preferably in an amount of up to 80 wt. %, more preferably in an amount of 5 wt. % to 60 wt. %, more preferably in an amount of 5 wt. % to 25 wt. %, based on the total amount of binder material.

The reinforcing fibers may be any type of fibers capable of resisting the temperature at which the mixture comprising a particulate material and a binder material is introduced into the void volumes of the three-dimensional material, including polyamide fibers, such as polyamide-6 fibers, polyester fibers, such as polyethylene terephthalate fibers, polyolefin fibers, such as polypropylene fibers, or a blend of at least two of said fibers. Preferably, the reinforcing fibers are fibers from a renewable source, such as cellulose fibers, and may include natural fibers, such as for example hemp fibers or flax fiber.

The erosion control system for preventing erosion of embankments or slopes may comprise one or more pigments to provide the erosion control system with a colour. The one or more pigments may be comprised in the three-dimensional material and/or in the binder material comprised in the erosion control system, may be mixed into the mixture comprising the particulate material and the binder material, or may applied onto a surface of the erosion control system.

The erosion control system may include one or more pigments, including green and/or brown pigments, which provides the erosion control system with a more natural colour to enable an improved natural appearance of the surface to be protected until plant material has grown on and/or through the erosion control system.

The erosion control system may include one or more pigments, which provides the erosion control system with a distinct colour, including red and/or blue pigments, different from natural occurring colours in embankments, to facilitate complete removal of the erosion control system at the end of life.

The invention claimed is:

1. An erosion control system for preventing erosion of embankments comprising a three-dimensional textile material, the three-dimensional textile material comprising void volumes, and a mixture comprising a particulate material having a particle size in a range of 0.5 to 15 mm and a binder material comprised in the void volumes, wherein the erosion control system has an areal weight in a range of 15 $kg/m^2$ to 50 $kg/m^2$, wherein the binder material comprises a lignin-based binder material, wherein the particulate material by itself or the particulate material with the binder material has a density that is higher than the density of water, and wherein the binder material comprised in the void volumes comprises a lignin-based binder in an amount of at least 20 wt. % and at most 80 wt. % of a bitumen-based binder, based on a total amount of binder material.

2. The erosion control system according to claim 1, wherein the three-dimensional textile material comprises a two-dimensional material and loops extending perpendicular from a surface of the two-dimensional material wherein the three-dimensional textile material comprises void volumes between the loops extending perpendicular from the surface of the two-dimensional material.

3. The erosion control system according to claim 1, wherein the three-dimensional textile material comprises a three-dimensional woven fabric or a three-dimensional knitted fabric.

4. The erosion control system according to claim 1, wherein the three-dimensional textile material comprises a three-dimensional structure of filaments, the filaments being thermally bonded at crossing points between the filaments.

5. The erosion control system according to claim 4, wherein the three-dimensional structure of filaments comprised in the three-dimensional textile material is connected to a two-dimensional material layer.

6. The erosion control system according to claim 5, wherein the two-dimensional material layer is a geogrid, a closed film, a perforated film, a non-woven fabric, a knitted fabric or a woven fabric.

7. The erosion control system according to claim 5, wherein the two-dimensional material layer is a two-dimensional layer of filaments, and wherein the two-dimensional layer of filaments is formed simultaneously with the three-dimensional structure of filaments in an integrated process.

8. The erosion control system according to claim 5, wherein the two-dimensional material layer is embedded in the three-dimensional material.

9. The erosion control system according to claim 1, wherein the mixture comprising the particulate material and the binder material comprised in the void volumes of the three-dimensional textile material comprises reinforcing fibers.

10. The erosion control system according to claim 1, wherein the erosion control system has a porosity in a range of 15% to 70%.

11. The erosion control system according to claim 1, wherein the three-dimensional material is composed of a polymer selected from the group consisting of: polyethylene terephthalate (PET), polybutylene terephthalate (PBT), polytrimethylene terephthalate (PTT), polyethylene naphthalate (PEN), polylactic acid (PLA), polyamide-6 (PA6), polyamide-6,6 (PA6,6), polyamide-6,10 (PA6,10), polyphenylenesulfide (PPS), polyethyleneimide (PEI), polyoxymethylene (POM), and any combination thereof.

12. A process for manufacturing an erosion control system for preventing erosion of embankments comprising the steps of supplying a three-dimensional textile material, the three-dimensional textile material comprising void volumes, supplying a mixture comprising a particulate material having a particle size in a range of 0.5 to 15 mm and a lignin-based binder material, and introducing the mixture into the void volumes of the three-dimensional textile material to provide an erosion control system having an areal weight in a range of 15 $kg/m^2$ to 50 $kg/m^2$, wherein the particulate material by itself or the particulate material with the binder material has a density that is higher than the density of water, and wherein the binder material comprised in the void volumes comprises a lignin-based binder in an amount of at least 20 wt. % and at most 80 wt. % of a bitumen-based binder, based on a total amount of binder material.

13. The process for manufacturing an erosion control system according to claim 12, wherein the three-dimensional textile material comprises a three-dimensional structure of entangled filaments, the entangled filaments being thermally bonded at crossing points between the filaments.

14. The process for manufacturing an erosion control system according to claim 13, wherein the process comprises the step of connecting the three-dimensional structure of entangled filaments comprised in the three-dimensional textile material to a two-dimensional material layer.

* * * * *